US005787628A

United States Patent [19]

Teetzel

[11] Patent Number: 5,787,628

[45] Date of Patent: Aug. 4, 1998

[54] LESS THAN LETHAL APPARATUS ATTACHMENT FOR A FIREARM

[76] Inventor: James W. Teetzel, 14 Stratham Green, Stratham, N.H. 03885

[21] Appl. No.: 543,198

[22] Filed: Oct. 13, 1995

[51] Int. Cl.[6] ..... F41C 27/00

[52] U.S. Cl. ..... 42/1.08; 222/79

[58] Field of Search ..... 42/1.08, 1.09, 42/1.11, 1.13; 89/1.1, 1.11; 116/DIG. 44, 83; 222/175, 192, 78, 79, 608, 610

[56] References Cited

U.S. PATENT DOCUMENTS

| | | | |
|---|---|---|---|
| 4,058,921 | 11/1977 | Mason | 42/1.08 |
| 4,316,338 | 2/1982 | Mason et al. | 42/1.08 |
| 4,930,392 | 6/1990 | Wilson | 89/1.11 |
| 5,195,448 | 3/1993 | Sims | 109/6 |
| 5,225,623 | 7/1993 | Krasnow | 89/1.1 |
| 5,363,769 | 11/1994 | Bellak et al. | 102/446 |
| 5,397,029 | 3/1995 | West | 222/79 |
| 5,424,712 | 6/1995 | Rosenberger | 340/426 |
| 5,473,501 | 12/1995 | Claypool | 361/232 |
| 5,549,220 | 8/1996 | Whalen | 222/1 |
| 5,671,559 | 9/1997 | Ludaesher et al. | 42/1.08 |

FOREIGN PATENT DOCUMENTS

| | | | |
|---|---|---|---|
| 118813 | 9/1918 | United Kingdom | 42/1.08 |

*Primary Examiner*—Michael J. Carone
*Assistant Examiner*—Christopher K. Montgomery
*Attorney, Agent, or Firm*—William B. Ritchie; Michael J. Persson

[57] ABSTRACT

A less than lethal chemical apparatus that can be fitted to conventional handguns and rifles without requiring major modification of the weapons and yet fits within the profile of the weapons framework. The invention features a chassis containing a chemical module that can house MACE or other incapacitating chemical agents such as tear gas that can be mounted in various positions, depending on the weapon selected. For a handgun, the chassis mounts on the front face of the muzzle. The weapons factory installed hand grips are replaced by modified hand grips that contain electronic controls, water proof activation switches, and a power source. The hand grips are wired to the chassis via a flexible internal circuits. The apparatus can also be activated at a distance from the firearm using an infrared activation control.

8 Claims, 3 Drawing Sheets

LESS THAN LETHAL APPARATUS ATTACHMENT FOR A FIREARM

BACKGROUND OF THE INVENTION

1. Field of the Invention

The invention relates to an apparatus for chemical agent dispensing apparatusfor incapacitating a person using less than lethal force.

2. Description of the Related Art

The use of incapacitating agents such as OC, i.e., pepper spray, or CS, CN, MACE and a variety of other chemical agents has increased substantially over recent years. While the increase in the crime rate and public concern for personal protection accounts for a substantial portion of the increase, the recognition that law enforcement personnel can also benefit from the availability of a reliable incapacitating force that is non-lethal under most usual circumstances. However, since deaths have occasionally resulted from all of these substances, such agents are generally referred to as "less than lethal" rather than non-lethal.

Typically, the chemical agents such as MACE are packaged within a pressurized canister that can propel toward the person that is to be incapacitated when a release mechanism is activated. While such devices are quite effective, they present law enforcement with just one more thing that he/she has to carry. Therefore, the ideal situation would be to incorporate this type of device into an item that is already being carried by all law enforcement personnel . . . the police officer's handgun. Since the officer's handgun is essential for those rare situations where the use of deadly force must be readily available in order to save the life or prevent bodily injury to the officer or others, the efficiency of the handgun cannot be compromised.

While the degree of accuracy necessary for police emergencies is less than typical target shooting situations, accuracy in the law enforcement situation may be critical for the officer's survival. Law enforcement officials are instructed to fire only as a last resort, cognizant of the fact that their intended target will most likely be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet, where millimeters and milleseconds can mean the difference between death and survival, cannot be known a priori by even the most skilled marksman. Therefore, the addition of a less than lethal chemical apparatus must not interfere with the normal carrying and use of the officer's service handgun.

Another problem that an officer faces when using a MACE canister or the like, is the Officer's hands are being occupied. The Officer is no longer free to instantly change to the use of deadly force if the situation requires it. The canister would have to be disposed of, then, his/her handgun drawn and fired. The extra time necessary to make the change-over could easily result in causing the Officer to be placed needlessly in mortal danger.

A less than lethal apparatus capable of being installed on an Officer's semi-automatic handgun, with a compact profile, and easily moveable from one weapon to another requiring a minimum replacement of standard parts is not disclosed in the prior art.

SUMMARY OF THE INVENTION

It is an aspect of the invention to provide a less than lethal chemical apparatus that can be attached to a standard semi-automatic firearm fitting within the profile of the weapon.

It is another aspect of the invention to provide a less than lethal chemical apparatus that can be retro-fitted to standard semi-automatic handguns or to standard military rifles.

It is still another aspect of the invention to provide a less than lethal chemical apparatus that can be easily moved from one weapon to another.

It is still another aspect of the invention to provide a less than lethal chemical apparatus that can be fitted to various semi-automatic handguns and military rifles requiring a minimum replacement of standard parts.

It is another aspect of the invention to provide a less than lethal chemical apparatus that can be inexpensively produced using primarily commercially available parts.

It is another aspect of the invention to provide a less than lethal chemical apparatus that is extremely light and can be activated without the Officer removing his/her hand from his/her service handgun.

It is still another aspect of the invention to provide a less than lethal chemical apparatus that can be controlled using an easily operated keypad.

It is a final aspect of the invention to provide a less than lethal chemical apparatus wherein an Officer can immediately switch to the use of lethal force if the situation warrants such a response.

The invention is a less than lethal chemical module for a firearm. A mount adaptor mountable on said firearm is provided. A chemical module containing an incapacitating agent, releasably attachable to said mount adaptor is provided. Said chemical module has a front spray orifice for releasing the incapacitating chemical housed within said chemical module. The chemical agent is sprayed through said front spray orifice where it is directed towards the person who is to be incapacitated. Control means for controlling the operation of said chemical module is provided. Connection means for communication between said chemical module is provided. A signal from an operator indicates said chemical module is to be activated and said signal is communicated to said chemical module. Said chemical module can be easily moved to a different weapon so equipped without the need for additional modifications.

DETAILED DESCRIPTION OF THE INVENTION

Figure 1:
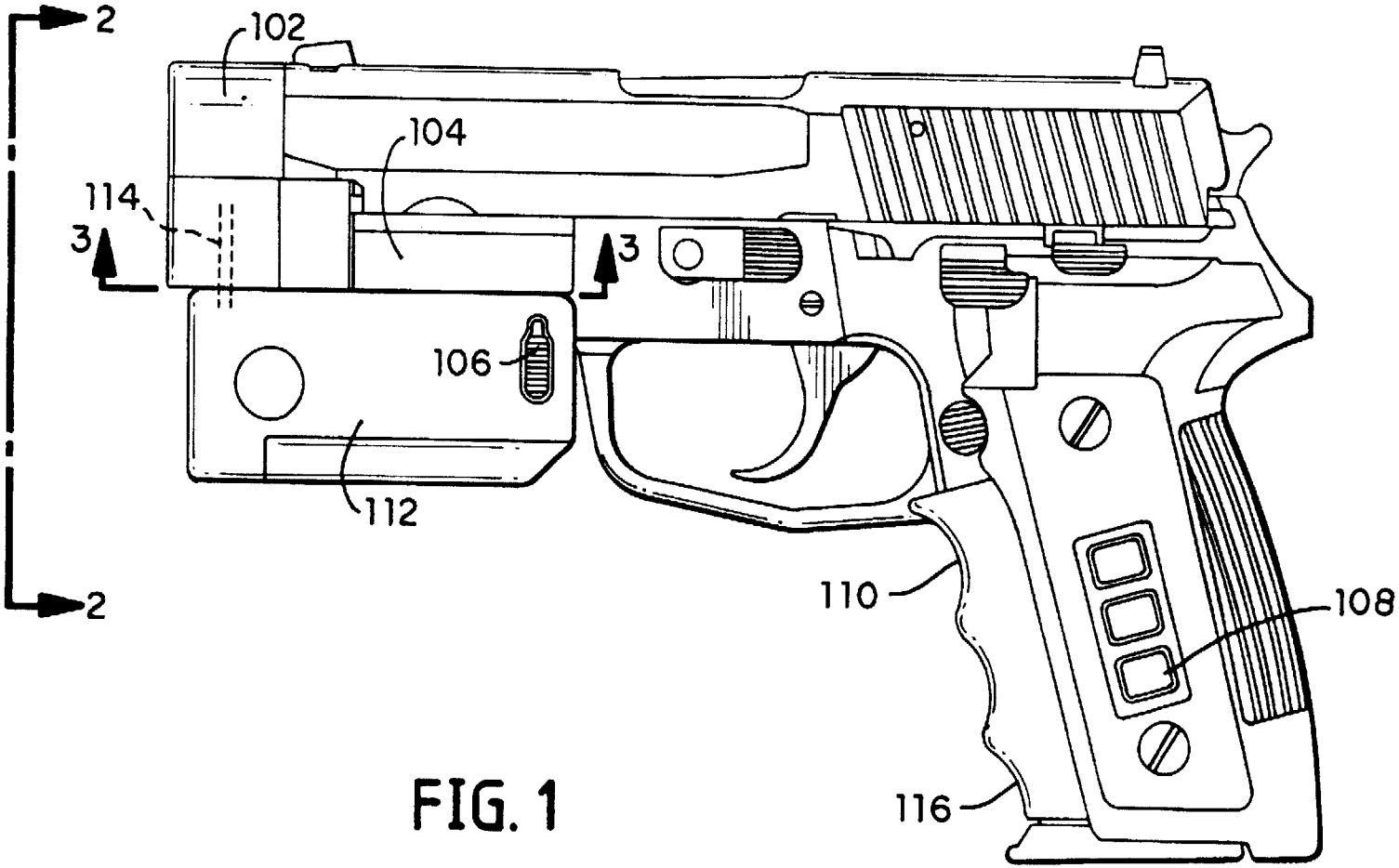
FIG. 1 is a side view of the less than lethal chemical module mounted on a typical handgun.

The invention is an apparatus for attaching a chemical module to a firearm, such as an offensive handgun. The device can also be used on a military rifle. The type of incapacitating chemical agents that can be used are MACE, tear gas such as CS and CN, or OC pepper sprays, or any combinations thereof. Typically, these agents are delivered via a pressurized aerosol that causes the person to become immediately incapacitated due to difficulties in breathing, seeing, etc. As shown in FIG. 1, chemical module 112 attaches to the weapon via mount-adaptor 104 which allows the operator to quickly move module 10 from one weapon platform to another or to be used as an independent handheld unit. The unit is designed so that it can be used with the inventor's laser sighting apparatus 102 and mount adaptor 104, described in U.S. patent application Ser. No. 08/488,631, filed Jun. 7, 1995, incorporated herein in its entirety.

Chemical module 112 utilizes manual keypad control 108 for the operation through the depression of the activation keypad 110 located below rubber boot 116. Signal 114 is communicated from the grip circuitry via the internal flex routing and the laser sighting chassis 102. Chassis 102 emits an infrared signal 114 which controls module 112. The signal 114 causes an electronic impulse to actuate a solenoid (not shown) which releases the stored chemical agent within module 112. Module 112 could also be controlled by chassis 102 via infrared signal when module 112 was detached from the weapon if that was desired. Since IR detector is used to control module 112, module 112 can be controlled at a remote distance by a device such as the inventor's laser sight that is capable of emitting the appropriate infrared. Quick release lever 106 secures module 10 to mount adapter 104.

Figure 2:
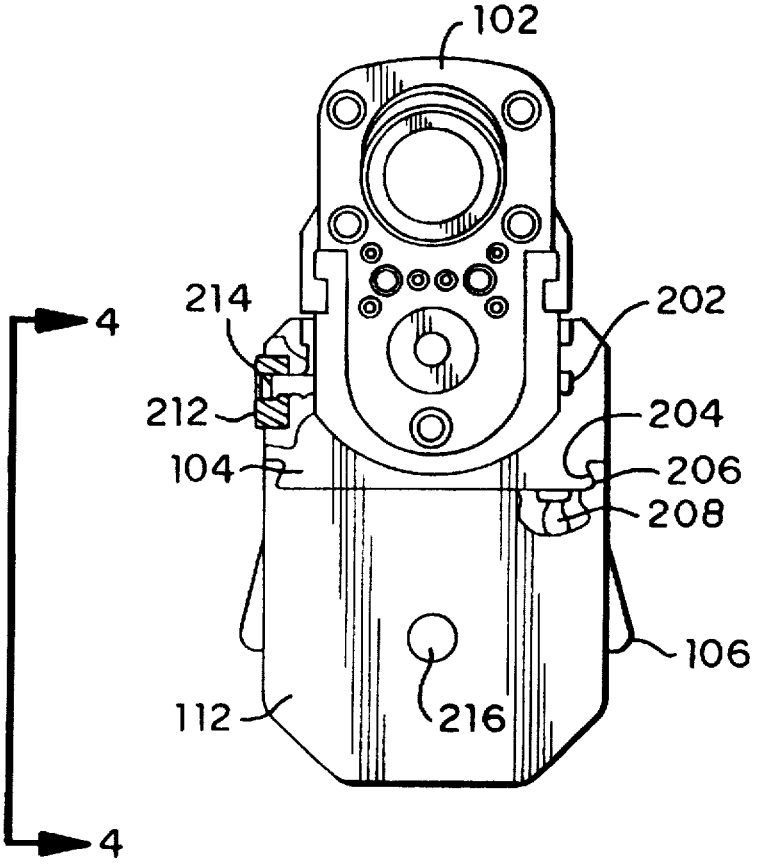
FIG. 2 is a front view along section line AA of FIG. 1.
Figure 3:
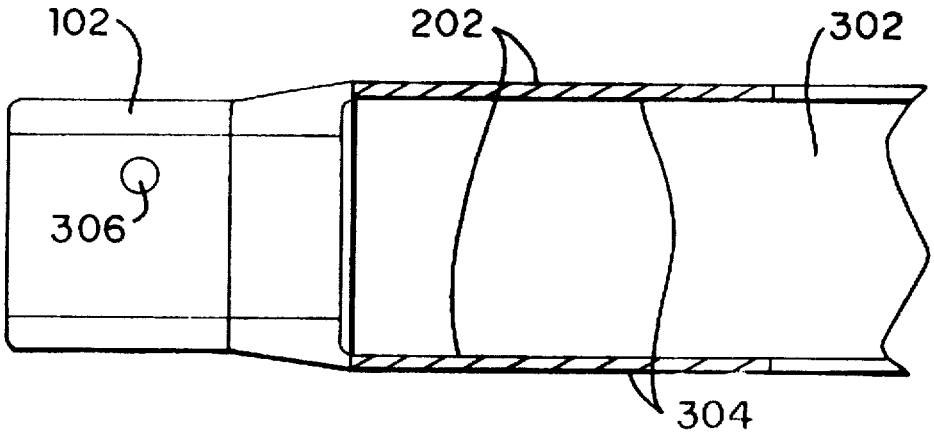
FIG. 3 is a detailed sectional view along section line BB of FIG. 1.

Referring now to FIGS. 2 and 3, the details of how module 112 is attached to the firearm will be discussed. Two plastic or aluminum rails 202 are affixed via double side adhesive 304 to the firearm chassis 302. Mount adaptor 104 is secured to capture rails 202 by sliding mount adaptor 104 along the two capture rails 202 until locked in position utilizing sliding activator 212 that causes locking pin plunger 214 to locate and lock into a corresponding locking pin hole 218 in mount adaptor 104. Locking pin plunger 214 is located on only one side of capture rails 202 and is molded as part of capture rail 202 itself. Counterbore 218 is machined into mount adaptor 104 and corresponds to a diameter and depth such that locking pin plunger 214 will fit. Capture rails 202 are manufactured from either plastic or aluminum.

Surface contour 240 of mount adaptor 104 is dimensioned to fit the profile of the weapon. When mount adaptor 104 is mounted on a different weapon, surface contour 240 or other aspects of the geometry of the weapon may change. However, the attachment apparatus features described herein will be substantially the same for every version. In this manner, module 112 can be moved from weapon to weapon without requiring any modifications.

Module 10 is attached to mount adaptor 104 via female dovetail 204 and male dovetail 206. Female dovetail 204 is on module 112, as shown in FIG. 2, with the corresponding male dovetail on mount adaptor 104. Positioning of male dovetail 206 and female dovetail 204 can be reversed and their purpose of securing module 112 to mount adaptor 104 would not be impacted.

Release lever 106 is firmly pressed which forces locking pin plunger 208 to recess flush with module top 220. This allows module 112 to engage dovetails 204 and 206. After engagement has passed locking pin plunger 208, release lever 106 can be released while flashlight module 10 is slid into place. When the operator hears locking pin plunger 208 clicking into counterbore 209, module 112 is firmly secured to mount adaptor 104. Counterbore 209 is machined into mount adaptor 104 and corresponds to a diameter and depth such that locking pin plunger 208 will fit.

For interchangability of module 112, the operator presses release lever 106 and slides flashlight module 10 along dovetails 204 and 206.

As shown in FIG. 3, double sided adhesive tape 304 is applied to weapon frame 302 which provides the support required to hold mounting adaptor 104 in place. When the weapon utilizes laser sight chassis 102, chemical spray operation can be accomplished via activation keypad 108. An infrared signal is routed through the weapon to infrared emitter port (not shown) of the chassis. The preferred parts list and electrical connections have been previously described in great detail in the U.S. patent application Ser. No. 08/303,860, incorporated herein.

Figure 4:
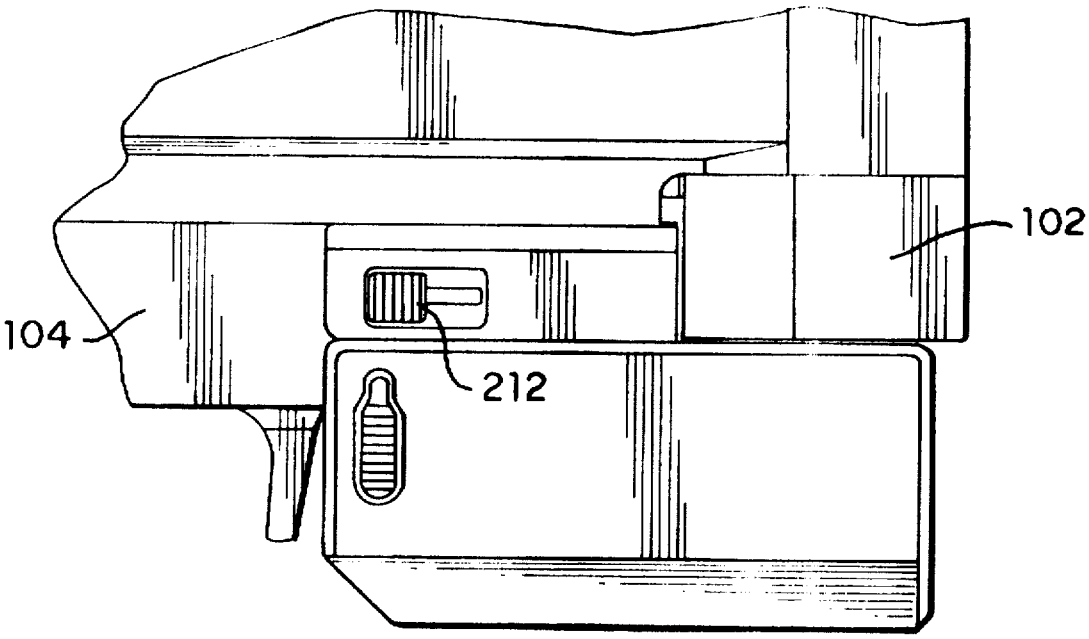
FIG. 4 is a partial detailed side view along section line DD of FIG. 2.

As shown in FIG. 4, module 112 is attached to mount adaptor 104 which is secured to the weapon. A side view of the weapon clearly shows sliding activator 212. Sliding activator 212 locks mount adaptor 104 to capture rails 202, which are shown in FIG. 3.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A chemical incapacitating apparatus for a firearm comprising:

a mount adaptor mountable on said firearm via two rails that are attached to said firearm using two-sided adhesive;

a chemical module, releasably attachable to said mount adaptor, said chemical module adapted to house an incapacitating amount of a less than lethal chemical agent, said chemical module having a front orifice adapted to release said chemical agent and wherein said chemical module is released from said mount adaptor via a quick release lever;

an electromagnetic control connected to said chemical module such that when said electromagnetic control is activated, said chemical agent is sprayed through said orifice.

2. The chemical incapacitating apparatus of claim 1 wherein said firearm has handgrips and said electromagnetic control further comprises an activation pad attached to the handgrips of said firearm.

3. The chemical incapacitating apparatus of claim 2 wherein said electromagnetic control controls said chemical module through an infrared signal.

4. A chemical incapacitating apparatus comprising:

a chemical module adapted to house an incapacitating amount of a less than lethal chemical agent, said chemical module having an orifice adapted to release said chemical agent;

an infrared detector, said infrared detector providing an output signal when said infrared detector receives an infrared signal;

a mount adaptor mountable on a firearm, said mount being attached to said firearm via two rails that are attached to said firearm using two-sided adhesive, said apparatus being releasably attachable to said mount;

control means for controlling the operation of said chemical module using said output signal of said infrared detector, wherein detection of said infrared signal causes said output signal to activate said chemical module thereby releasing said less than lethal chemical agent through said orifice;

keypad means for independently controlling the operation of said apparatus, said keypad means being attached to said firearm.

5. A chemical incapacitating apparatus for a firearm having a barrel comprising:

a mount adaptor mountable on said firearm;

a chemical module, releasably attachable to said mount adaptor such that said chemical module is released from said mount adapter via a quick release lever, said chemical module adapted to house an incapacitating amount of a less than lethal chemical agent, said chemical module having a front facing orifice adapted to release said chemical agent in substantially the same direction that the barrel of the firearm is pointing;

an electromagnetic control connected to said chemical module such that when said electromagnetic control is activated, said chemical agent is sprayed through said orifice.

6. The chemical incapacitating apparatus for a firearm of claim 5 wherein said mount adapter is attached to said firearm via two rails that are attached to said firearm using two-sided adhesive.

7. The chemical incapacitating apparatus of claim 6 wherein said firearm has handgrips and said electromagnetic control further comprises an activation pad attached to the handgrips of said firearm.

8. The chemical incapacitating apparatus of claim 7 wherein said electromagnetic control controls said chemical module through an infrared signal.

* * * * *